US010149027B2

(12) United States Patent
Xu

(10) Patent No.: US 10,149,027 B2
(45) Date of Patent: Dec. 4, 2018

(54) SPEAKER BOX

(71) Applicant: Yunxia Xu, Shenzhen (CN)

(72) Inventor: Yunxia Xu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 68 days.

(21) Appl. No.: 15/001,685

(22) Filed: Jan. 20, 2016

(65) Prior Publication Data

US 2016/0227305 A1 Aug. 4, 2016

(30) Foreign Application Priority Data

Feb. 2, 2015 (CN) ..... 2015 2 0073415 U

(51) Int. Cl.

*H04R 1/02* (2006.01)
*H04R 9/02* (2006.01)
*H04R 7/20* (2006.01)

(52) U.S. Cl.

CPC ..... *H04R 1/021* (2013.01); *H04R 7/20* (2013.01); *H04R 9/02* (2013.01); *H04R 9/025* (2013.01); *H04R 2499/11* (2013.01)

(58) Field of Classification Search

CPC . H04R 1/021; H04R 7/20; H04R 9/02; H04R 9/025; H04R 2499/11

See application file for complete search history.

(56) References Cited

U.S. PATENT DOCUMENTS 2,358,823 A * 9/1944 O'Connor ..... H04R 7/12 181/172
4,252,211 A * 2/1981 Matsuda ..... H04R 1/22 181/166
6,851,513 B2 * 2/2005 Stead ..... G10K 13/00 181/157
7,142,686 B2 * 11/2006 Furuya ..... H04M 1/035 381/396
7,567,680 B2 * 7/2009 Murray ..... H04M 1/03 379/428.01
8,189,848 B2 * 5/2012 Lim ..... H04M 1/035 381/162
2003/0003945 A1 * 1/2003 Saiki ..... H04M 1/03 455/550.1
2006/0126870 A1 * 6/2006 Wu ..... H04R 1/345 381/306
2007/0189574 A1 * 8/2007 Suzuki ..... H04M 1/035 381/396
2009/0291718 A1 * 11/2009 Fukazawa ..... H04M 1/03 455/575.1

* cited by examiner

*Primary Examiner* — Matthew A Eason
*Assistant Examiner* — Taunya McCarty
(74) *Attorney, Agent, or Firm* — Na Xu; IPro, PLLC

(57) ABSTRACT

A speaker box with side acoustic emission structure is disclosed. The speaker box has a case having an acoustic window, a speaker unit mounted in the case and including a diaphragm, a voice coil and a magnetic circuit, the diaphragm disposed in the side of the acoustic window and not faced to the acoustic window and having a dome and a suspension surrounding the dome, the suspension comprising a first end close to the acoustic window and a second end away from the acoustic window, and the first end is lower than the second end along the vibrating direction.

9 Claims, 3 Drawing Sheets

SPEAKER BOX

RELATED PATENT APPLICATION

This application claims the priority benefit of Chinese patent Application Filing Serial Number CN 201520073415.1, filed on Feb. 2, 2015, the disclosure of which is herein incorporated by reference in its entirely.

FIELD OF THE INVENTION

The present disclosure relates to the art of speakers and, particularly to a speaker box with improved the acoustic performances.

DESCRIPTION OF RELATED ART

In modern consumer electronics, audio capability is playing an increasingly greater role as improvements in digital audio signal processing and audio content delivery continue to happen. There is a range of consumer electronics devices that are not dedicated or specialized audio playback devices, yet can benefit from improved audio performance. For instance, smart phones are ubiquitous.

In general, the conventional speaker box includes a micro-speaker, and a case for receiving the micro-speaker. To achieve a better audio performance, the case is usually provided with a large inner cavity, as well as an acoustic emission passage for sound generated by the micro-speaker to pass through.

Typically, the magnitude of the sound is expressed in dB and represented as a sound pressure level (SPL) or efficiency in a speaker box. This means 'the average magnitude of the sound that can be heard 1 m from the micro-speaker, when an output of 1 w is transferred from an amplifier to the micro-speaker'. Therefore, the greater the sound pressure is, the greater the reproduced sound is with the same output of the amplifier.

Generally, the acoustic emission passage ends at a lateral surface of the case by an emitting opening which is defined at a position deviating from the micro-speaker's center. As a line for emitting sounds gets narrower, a sound pressure in low frequencies becomes lower. Specifically, in low frequencies having relatively large amplitudes, an amount of pushing the air increases. As the air passes through such a narrow line, the acoustic resistivity of the one portion of the diaphragm close to the emitting opening is greater than that of the other portion of the diaphragm far away from the opening. Consequently, the sound pressure imposed on the surface of the diaphragm becomes unbalanced, which degrades low sound characteristics.

In view of the above described situation, there exists a need for an improved speaker box which can substantially avoid the above-identified problems.

BRIEF DESCRIPTION OF THE DRAWINGS

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Figure 1:
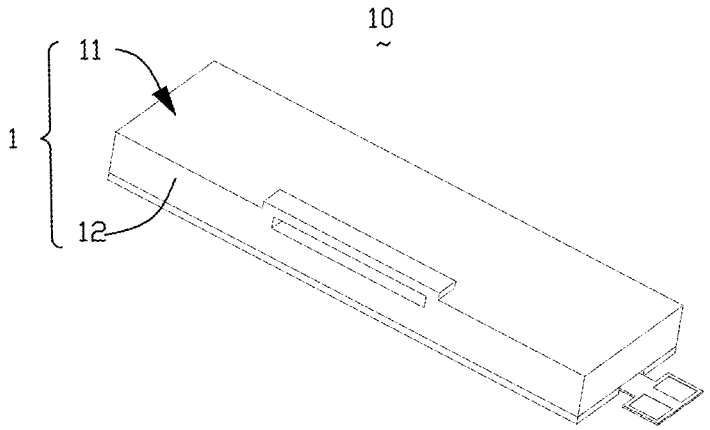
FIG. 1 is an illustrative view of a speaker box in accordance with an exemplary embodiment of the present invention.

A speaker box in accordance with an exemplary embodiment of the present disclosure is used for converting audio electrical signals to audible sounds. In general, the speaker box includes a cabinet, and a speaker unit mounted in the cabinet. The cabinet has an acoustic opening provided in one sidewall of cabinet for emitting sounds. The speaker unit has a magnetic circuit, a vibrating unit corresponding to the magnetic circuit, and a PCB board electrically connecting with the vibrating unit for conducting electrical signals to the vibrating unit.

Referring to FIGS. 1-4, a speaker box 10 in accordance with an exemplary embodiment of the present disclosure, includes a cabinet 1 defining a case 11, a cover 12 assembled with the case 11 for forming a receiving space 100, a speaker unit 13 received in the receiving space 100 and a PCB board 14 electrical connected with the speaker unit 13 and extends out of the receiving space 100 for electrically connecting to an outer circuit.

In the present embodiment, the case 11 which is composed of an injection-molded product, includes a bottom wall 110 in shape of rectangle, a sidewall 111 extending upwardly and perpendicularly from the bottom wall 110, and an acoustic window 112 formed in the sidewall 111 by injection molding technology for communicating with the speaker unit 13 for emitting sounds. Hereby, while the speaker unit 13 is configured in the receiving space 100 and faced the bottom wall 110 of the case 11 so as to provide an acoustic device with side acoustic emission structure. The shape of the cabinet 1 is not restricted to rectangle as described in the embodiment. In another embodiment, the case 11 may be configured to be like a bowel and has a chamber for accommodating the speaker unit 13.

Figure 2:
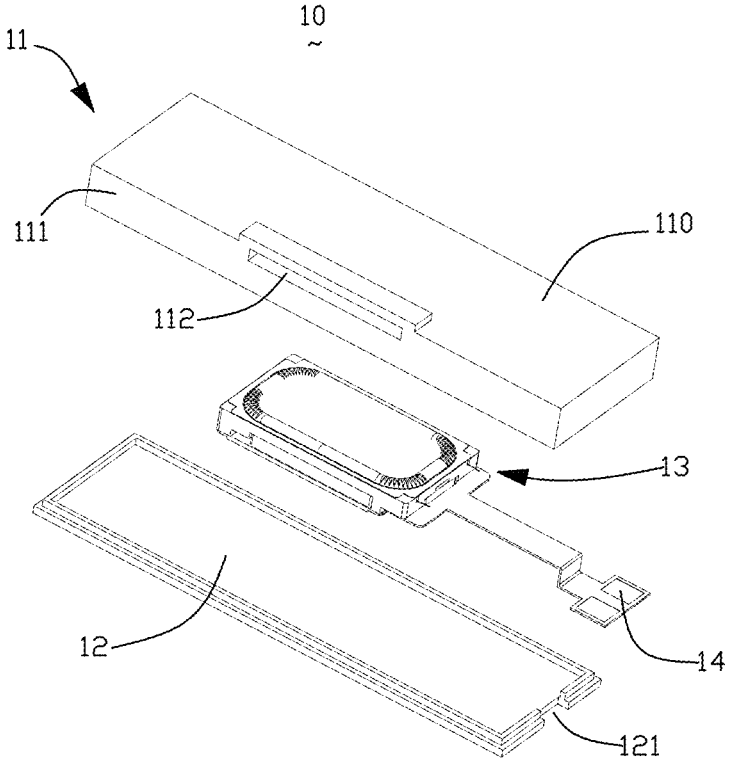
FIG. 2 is an exploded view of the speaker box in FIG. 1.

As shown in FIG. 2, the case 11 is assembled with the cover 12 by interference fitting, and a slot 121 is defined on the cover 12 for the PCB board 14 to extend outwards from the cabinet 1.

Figure 3:
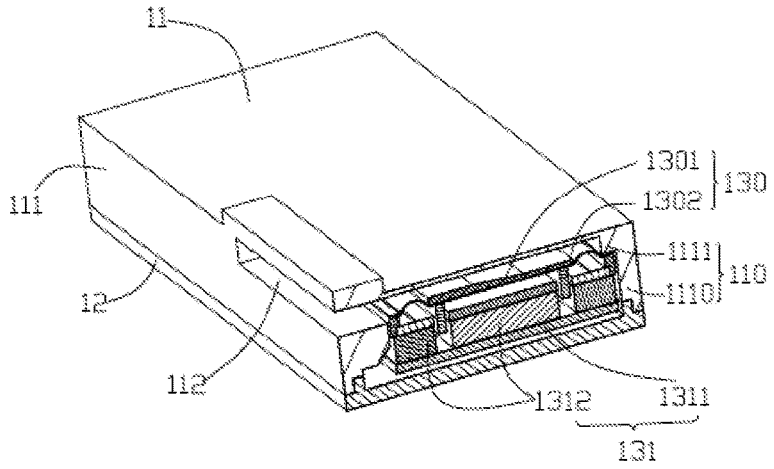
FIG. 3 is a schematic cutaway view of the speaker box in FIG. 1 in a first direction.
Figure 4:
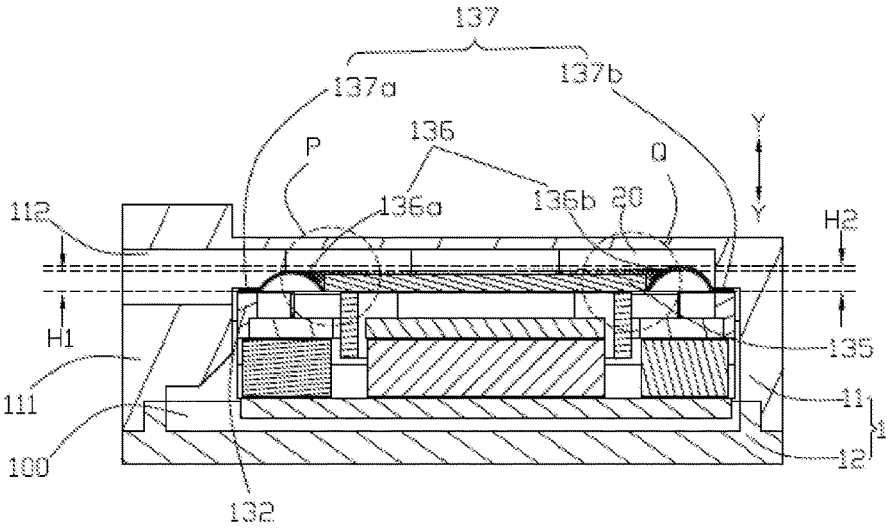
FIG. 4 is a schematic cutaway view of the speaker box in FIG. 1 in a second direction.

Referring to FIGS. 3-4, the speaker unit 13 includes a vibrating unit 130 and a magnetic circuit 131 mounted in the case 11. The magnetic circuit 131 includes a yoke 1311 mounted on the cover 12, and a magnet 1312 mounted on the yoke 1311. The vibrating unit 130 comprises a diaphragm 1301 and voice coil 1302 connected directly or indirectly with the diaphragm 1301 and actuated by the magnetic field of the magnetic circuit 131. In the present embodiment, the diaphragm 1301 is configured to face the bottom wall 110 of the case 11 so as to form a narrow acoustic passage 20 which is communicated with the acoustic window 112. In other words, the narrow acoustic passage 20 is formed between the diaphragm 1301 and the bottom wall 110. While assembled, the diaphragm 1301 may vibrate along a vibrating direction Y-Y substantially perpendicularly to the bottom wall 110 of the case 11, and sound waves are emitted out from the acoustic window 112.

As shown in FIG. 4, the diaphragm 1301 usually is mounted on the magnet circuit 131, and includes a dome 135 and a suspension 136 surrounding the dome 135. In the present embodiment, the diaphragm 1301 may be an oval corresponding to magnetic circuit 131. It is understandable that the diaphragm 1301 should not be limited to be an oval, for example, it may be shaped as a rectangle. Furthermore, the dome 135 is lower than the suspension 136 along the vibrating direction Y-Y. Specifically, the suspension 136 includes a first end 136*a* close to the acoustic window 112 and a second end 136*b* far away from the acoustic window 112. The first end 136*a* has a height H1 along the vibrating direction Y-Y, and the second end 136*b* has a height H2 along the vibrating direction Y-Y. As shown in FIG. 4, since H1<H2, the first end 136*a* is lower than the second end along the vibrating direction Y-Y.

Figure 5:
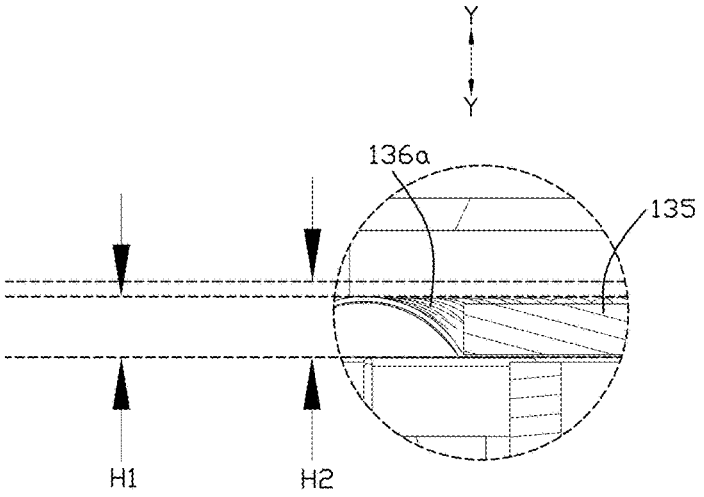
FIG. 5 is an enlarged view of part P of the speaker box in FIG. 4.
Figure 6:
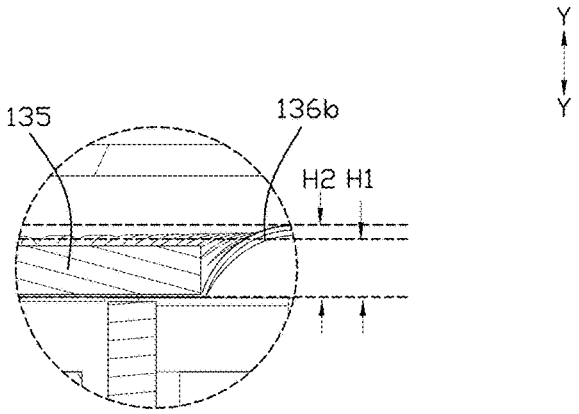
FIG. 6 is an enlarged view of part Q of the speaker box in FIG. 4.

Referring to FIG. 5 and FIG. 6, the dome 135 is a flat board, and the dome 135 is lower than the first end 136*a* and the second end 136*b*. Referring to FIG. 3 and FIG. 4, the speaker unit includes the diaphragm 1301, the voice coil 1302, the magnetic circuit 131 mounted in the case and a frame 132 mounted on the magnetic circuit 131 to support the diaphragm 1301. The diaphragm 1301 further includes a connecting part 137 fixed to the frame 132. The suspension 136 is formed between the connecting part and the dome 135 and connecting to the connecting part 137 and the dome 135 respectively. The connecting part 137 close to the second end 136*b* is sandwiched between the side wall 111 and the frame 132. The curvature protrudes towards the bottom wall 110. The connecting part 137 further comprises a third end 137*a* connecting to the first end 136*a*, and a fourth end 137*b* connecting to the second end 136*b*. The sidewall 111 comprises a main body 1110 extending perpendicularly from the bottom wall and a protruding part 1111 extending from the main body 1110 towards the acoustic window 112. The fourth end 137*b* of the connecting part 137 is sandwiched between the protruding part 1111 and the frame 132, and one side of the third end 137*a* away from the frame 132 is exposed in the case 11.

Because the first end 136*a* is lower than the second end 136*b* along the vibrating direction Y-Y, the second end 136*b* is more easily to vibrate, and the second end 136*b* can achieve a better mechanical compliance than the first end 136*a*, and thus the diaphragm can perform a balanced vibration. The problem of unbalanced sound pressure imposed on the surface of the diaphragm is solved.

While the present disclosure has been described with reference to the specific embodiments, the description of the disclosure is illustrative and is not to be construed as limiting the disclosure. Various modifications to the present disclosure can be made to the exemplary embodiments by those skilled in the art without departing from the true spirit and scope of the disclosure as defined by the appended claims.

What is claimed is:

1. A speaker box, comprising:

a case having a bottom wall, a sidewall extending upwardly and perpendicularly from the bottom wall, and an acoustic window formed in the sidewall;

a speaker unit mounted in the case and having a diaphragm positioned below the bottom wall of the case for forming an acoustic passage communicating with the acoustic window, a voice coil, and a magnetic circuit for driving the diaphragm to vibrate along a vibrating direction;

the diaphragm comprising a dome in a planar shape and a periphery having a suspension with a curvature connected to the dome, the suspension surrounding and supporting the dome, the suspension comprising a first end close to the acoustic window and a second end away from the acoustic window, and the first end is lower than the second end along the vibrating direction, wherein the dome is lower than the first end and the second end along the vibrating direction; the speaker unit comprises the diaphragm, the voice coil, the magnetic circuit mounted in the case and a frame mounted on the magnetic circuit to support the diaphragm, the diaphragm further comprising a connecting part fixed to the frame; the suspension is formed between the connecting part and the dome and connects to the connecting part and the dome respectively;

the connecting part further comprises a third end connecting to the first end, and a fourth end connecting to the second end, the sidewall comprises a main body extending perpendicularly from the bottom wall and a protruding part extending from the main body towards the acoustic window;

the fourth end of the connecting part is sandwiched between the protruding part and the frame, and one side of the third end away from the frame is exposed in the case.

2. The speaker box as claimed in claim 1, wherein the dome is a flat board.

3. A speaker box, comprising:

a cabinet having a side acoustic emission structure with an acoustic window formed on the cabinet and communicating the side acoustic emission structure with an outer environment of the speaker box, the cabinet including a case and a cover, the case having a bottom wall and a sidewall extending upwardly and perpendicularly from the bottom wall, and the acoustic window is formed in the sidewall;

a speaker unit mounted in the cabinet and including a diaphragm, a voice coil and a magnetic circuit for driving the diaphragm to vibrate along a vibrating direction;

the diaphragm disposed in the side acoustic emission structure and not faced to the acoustic window, the diaphragm having a dome in a planar shape and a suspension connected to the dome, and a suspension surrounding the dome, the suspension surrounding and supporting the dome, the suspension comprising a first end close to the acoustic window and a second end away from the acoustic window, and the first end is lower than the second end along the vibrating direction, wherein the dome is lower than the first end and the second end along the vibrating direction, the speaker unit comprises the diaphragm, the voice coil, the magnetic circuit mounted in the cabinet and a frame mounted on the magnetic circuit to support the diaphragm, the diaphragm further comprises a connecting part fixed to the frame, the suspension is formed between the connecting part and the dome and connects to the connecting part and the dome respectively;

the connecting part further comprises a third end connecting to the first end, and a fourth end connecting to the second end, the sidewall comprises a main body facing towards the acoustic window and a protruding part extending from the main body towards the acoustic window;

the fourth end of the connecting part is sandwiched between the protruding part and the frame, and one side of the third end away from the frame is exposed in the cabinet.

4. The speaker box as claimed in claim 3, wherein the diaphragm is positioned below the bottom wall of the case for forming an acoustic passage for communicating with the acoustic window.

5. The speaker box as claimed in claim 4, wherein the case is assembled with the cover to form a receiving space for receiving the speaker unit through interference fitting.

6. The speaker box as claimed in claim 5, wherein the speaker box also comprises a printed circuit board electrically connected with the speaker unit and extending out of the receiving space.

7. The speaker box as claimed in claim 6, wherein, the lower plate comprises a slot for the printed circuit board to extend outwards from the receiving space.

8. The speaker box as claimed in claim 1, wherein the curvature protrudes towards the bottom wall.

9. The speaker box as claimed in claim 3, wherein, the curvature protrudes towards the bottom wall.

* * * * *